US011703041B2

(12) United States Patent
Tamaki et al.

(10) Patent No.: US 11,703,041 B2
(45) Date of Patent: Jul. 18, 2023

(54) VEHICULAR ELECTRIC COMPRESSOR

(71) Applicant: MITSUBISHI HEAVY INDUSTRIES THERMAL SYSTEMS, LTD., Tokyo (JP)

(72) Inventors: Hitoshi Tamaki, Tokyo (JP); Manabu Suzuki, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 0 days.

(21) Appl. No.: 16/761,938

(22) PCT Filed: Oct. 9, 2018

(86) PCT No.: PCT/JP2018/037560
§ 371 (c)(1),
(2) Date: May 6, 2020

(87) PCT Pub. No.: WO2019/093043
PCT Pub. Date: May 16, 2019

(65) Prior Publication Data

US 2020/0325883 A1 Oct. 15, 2020

(30) Foreign Application Priority Data

Nov. 9, 2017 (JP) ..... 2017-216458

(51) Int. Cl.
*F04B 35/04* (2006.01)
*F04B 39/12* (2006.01)
*F04C 29/00* (2006.01)

(52) U.S. Cl.
CPC ..... *F04B 35/04* (2013.01); *F04B 39/121* (2013.01); *F04C 29/00* (2013.01); *F04C 2240/30* (2013.01);
(Continued)

(58) Field of Classification Search
CPC .... F04B 35/04; F04B 39/121; F04C 2240/30; F04C 2240/40; F04C 2240/403
See application file for complete search history.

(56) References Cited

U.S. PATENT DOCUMENTS 4,643,386 A * 2/1987 Chastine ..... F04B 39/121 248/632
6,585,241 B1 * 7/2003 Hartl ..... B61D 49/00 267/136
(Continued)

FOREIGN PATENT DOCUMENTS

JP 2002-533632 A 10/2002
JP 2004-44638 A 2/2004
(Continued)

OTHER PUBLICATIONS

Engineering plastic—Wikipedia, 2016.*
(Continued)

*Primary Examiner* — Christopher S Bobish
(74) *Attorney, Agent, or Firm* — Birch, Stewart, Kolasch & Birch, LLP

(57) ABSTRACT

A vehicular electric compressor (1) includes a compressor body (2) that compresses fluid sucked from outside and then discharges the fluid, using electric power as power, a protective component (4) attached on the compressor body (2), and an external attachment leg (3) attached to the compressor body (2) through the protective component (4). The protective component (4) is lower in strength than the external attachment leg (3).

3 Claims, 4 Drawing Sheets

(52) U.S. Cl.
CPC .... *F04C 2240/40* (2013.01); *F04C 2240/403* (2013.01)

(56) References Cited

U.S. PATENT DOCUMENTS

| | | | | |
|---|---|---|---|---|
| 8,714,943 | B2 * | 5/2014 | Bahmata | F04B 39/0044 403/365 |
| 9,068,458 | B2 * | 6/2015 | Ota | F04C 29/04 |
| 9,273,683 | B2 * | 3/2016 | Yokoi | B60H 1/00514 |
| 10,119,542 | B2 * | 11/2018 | Kang | F04C 29/06 |
| 10,982,672 | B2 * | 4/2021 | Scancarello | F04C 18/0215 |
| 2010/0226800 | A1 | 9/2010 | Ichise et al. | |
| 2012/0251358 | A1 | 10/2012 | Ota et al. | |
| 2015/0061558 | A1 * | 3/2015 | Yano | F04B 39/121 318/400.26 |
| 2015/0147205 | A1 | 5/2015 | Yamashita et al. | |
| 2016/0265523 | A1 * | 9/2016 | Kinoshita | F04C 28/28 |
| 2017/0184108 | A1 * | 6/2017 | Scancarello | F04C 29/063 |
| 2017/0259647 | A1 | 9/2017 | Nishibori et al. | |
| 2018/0134365 | A1 * | 5/2018 | Knipprath | B64C 3/187 |
| 2019/0160915 | A1 * | 5/2019 | Shin | F04B 39/0094 |
| 2020/0217321 | A1 * | 7/2020 | Scancarello | B22F 10/20 |

FOREIGN PATENT DOCUMENTS

| | | | |
|---|---|---|---|
| JP | 2009-85082 | A | 4/2009 |
| JP | 2010-270787 | A | 12/2010 |
| JP | 2012-47139 | A | 3/2012 |
| JP | 2012-211530 | A | 11/2012 |
| JP | 2015-105578 | A | 6/2015 |
| JP | 2016-118108 | A | 6/2016 |
| JP | 2016-125427 | A | 7/2016 |

OTHER PUBLICATIONS

International Search Report dated Jan. 8, 2019 for Application No. PCT/JP2018/037560, along with an English translation.

Written Opinion of the International Searching Authority dated Jan. 8, 2019 for Application No. PCT/JP2018/037560, along with an English translation.

Foreign Office Action issued for Japanese Patent Application No. JP 2017-216458 dated Jul. 13, 2021 with English translation.

* cited by examiner

VEHICULAR ELECTRIC COMPRESSOR

TECHNICAL FIELD

The present invention relates to a vehicular electric compressor to be mounted on an engine, an electric motor for traveling, or a body.

BACKGROUND ART

An electric compressor to be mounted on a vehicle such as an automobile and used for air conditioning (a vehicular air conditioner) in the vehicle has been conventionally known. FIGS. 4A and 4B are perspective views showing an example of a conventional compressor body. FIG. 4A is a perspective view of the compressor body seen from the inverter cover side, and FIG. 4B is a perspective view of the compressor body seen from the housing side. As shown in FIGS. 4A and 4B, the compressor body 102 includes a motor case 131 that accommodates a motor, a compression mechanism, and the like, and a housing (an upper housing) 121 that covers the motor case 131. An inverter case (a lower case) 111 that accommodates an inverter and the like is attached on the motor case 131 on the opposite side of the housing 121.

A compression mechanism, not shown, is accommodated in a part closer to the housing 121 from a central part of the motor case 131. Such a part forms a compression mechanism unit 120 that compresses fluid sucked from the outside and then discharges the fluid. A motor, not shown, is accommodated in a part closer to the inverter case 111 from the central part of the motor case 131. Such a part forms a motor unit 130 that drives the compression mechanism unit 120.

An inverter 112 that supplies electric power to the motor unit 130 is accommodated in the inverter case 111, and the inverter 112 accommodated in the inverter case 111 is covered with an inverter cover 113. With these components, an inverter unit 110 that operates the motor unit 130 is formed.

FIGS. 5A and 5B are perspective views showing an example of a conventional vehicular electric compressor. FIG. 5A is a perspective view of a vehicular electric compressor seen from the inverter cover side, and FIG. 5B is a perspective view of the vehicular electric compressor seen from the housing side. In the vehicular electric compressor 101 in FIGS. 5A and 5B, an external attachment leg (an electric compressor fastening attachment leg) 103 is attached to the inverter cover 113 of the compressor body 102 in FIGS. 4A and 4B. As with the vehicular electric compressor 101 in FIGS. 5A and 5B, there is a need in recent years for the external attachment leg 103 to be attached to the inverter cover 113 in some cases.

In the case where the external attachment leg 103 is attached to the inverter cover 113, however, an excessive load is to be exerted on the external attachment leg 103 when the vehicle collides. At this timing, a load is also exerted on the inverter cover 113 through the external attachment leg 103. For this reason, the inverter cover 113 might be broken due to the entrance of the load, and the inverter 112 might be exposed accordingly.

The technique as disclosed in, for example, PTL 1 is known as a technique for preventing such breakage of the inverter cover and the exposure of the inverter that occurs accordingly. PTL 1 discloses provision of an attachment leg unit on a cover that closes a space in which an inverter unit is accommodated, and the attachment leg unit is provided with a stress concentration portion on which stress is more concentrated than other parts. Thus, even in the case where the attachment leg unit is provided on the cover, when a large impact is given to the vehicle, the stress concentration portion of the attachment leg unit is preferentially broken and therefore the breakage of the cover can be prevented.

CITATION LIST

Patent Literature

[PTL 1]
Japanese Unexamined Patent Application, Publication No. 2016-118108

SUMMARY OF INVENTION

Technical Problem

The external attachment leg attached on the inverter cover, however, causes the load to enter the inverter cover directly from the external attachment leg. Therefore, the provision of the stress concentration portion in the external attachment leg as disclosed in PTL 1 cannot prevent the load from entering the inverter cover, and has not contributed to a fundamental solution of preventing the inverter cover breakage.

An object of the present invention, which has been made in view of the above circumstances, is to provide a vehicular electric compressor, by which a load exerted on a compressor body such as, for example, an inverter cover can be reduced and damage given to the compressor body can be reduced.

Solution to Problem

To address the above issues, the present invention adopts the following solutions.

The present invention provides a vehicular electric compressor including a compressor body that compresses fluid sucked from outside and then discharges the fluid, using electric power as power, a protective component attached on the compressor body, and an external attachment leg attached to the compressor body through the protective component, wherein the protective component is lower in strength than the external attachment leg.

In the vehicular electric compressor according to the present invention, the external attachment leg is attached to the compressor body. Accordingly, at the time of vehicle collision, an excessive load is exerted on the external attachment leg. At this timing, since the protective component is interposed between the compressor body and the external attachment leg, the above load is to be exerted on the protective component. The protective component is lower in strength than the external attachment leg, and thus the protective component is certainly broken upon receiving the above load. Therefore, breakage of the inverter cover and exposure of the inverter that occurs accordingly can be prevented.

In the above vehicular electric compressor, it is preferable that the compressor body includes a compression mechanism unit that compresses the fluid and then discharges the fluid, a motor unit that drives the compression mechanism unit, and an inverter unit that operates the motor unit, the inverter unit includes an inverter that supplies the electric power to the motor unit, an inverter case that accommodates the inverter, and an inverter cover that covers the inverter accommodated in the inverter case, and the external attachment leg is attached to the inverter cover.

In the case where the external attachment leg is attached to the inverter cover in this manner, the exposure of the inverter unit caused by the breakage of the inverter cover at the time of vehicle collision and risk of electric leakage that occurs accordingly can be reduced.

In the above vehicular electric compressor, it is preferable that the compressor body, the protective component, and the external attachment leg are separate components.

In the case where the compressor body, the protective component, and the external attachment leg are separate components, the protective component can be formed of a different material from the compressor body or the external attachment leg. Specifically, by forming the protective component with a material having a lower strength than the compressor body and the external attachment leg, the protective component can be more certainly broken at the time of vehicle collision.

In the above vehicular electric compressor, it is preferable that a connection between the compressor body and the protective component and another connection between the protective component and the external attachment leg are made respectively by different connection members.

In the case where the connection between the compressor body and the protective component and the connection between the protective component and the external attachment leg are made respectively by different connection members, the load to be exerted on the compressor body through the connection members at the time of vehicle collision can be prevented. Therefore, damage to the compressor body at the time of vehicle collision can be more certainly reduced.

For a material of the protective component, for example, engineering plastic (enpla) such as polyamide or polycarbonate, super engineering plastic (super enpla) such as polyimide, urethane-based rubber, an epoxy-based adhesive, and any combinations thereof can be cited. Aluminum alloy is typically used as a material for the compressor body and the external attachment leg. Hence, in the case where the above-described material is used for forming the protective component, the protective component having a lower strength than the compressor body and the external attachment leg can be formed more certainly.

In the above vehicular electric compressor, it is preferable that the protective component is integrated with the compressor body.

In the case where the protective component is integrated with the compressor body, the protective component can be formed of the same material with the compressor body. This can lower the weight of the electric compressor.

In the above vehicular electric compressor, it is preferable that the protective component has a lattice structure.

In the case where the protective component is integrated with the compressor body, the protective component can be formed to have a lattice structure. This can cause the protective component to absorb the impact more at the time of vehicle collision, can break the protective component, and can thus reduce the damage to the compressor body at the time of vehicle collision more certainly.

Advantageous Effects of Invention

In the vehicular electric compressor according to the present invention, exertion of a load to the compressor body such as, for example, an inverter cover can be reduced and damage to the compressor body can be reduced.

DESCRIPTION OF EMBODIMENTS

Hereinafter, an embodiment of a vehicular electric compressor according to the present invention will be described with reference to the drawings.

First Embodiment

Hereinafter, a vehicular electric compressor according to a first embodiment of the present invention will be described with reference to FIGS. 1A, 1B, and 2.

Figure 1A:
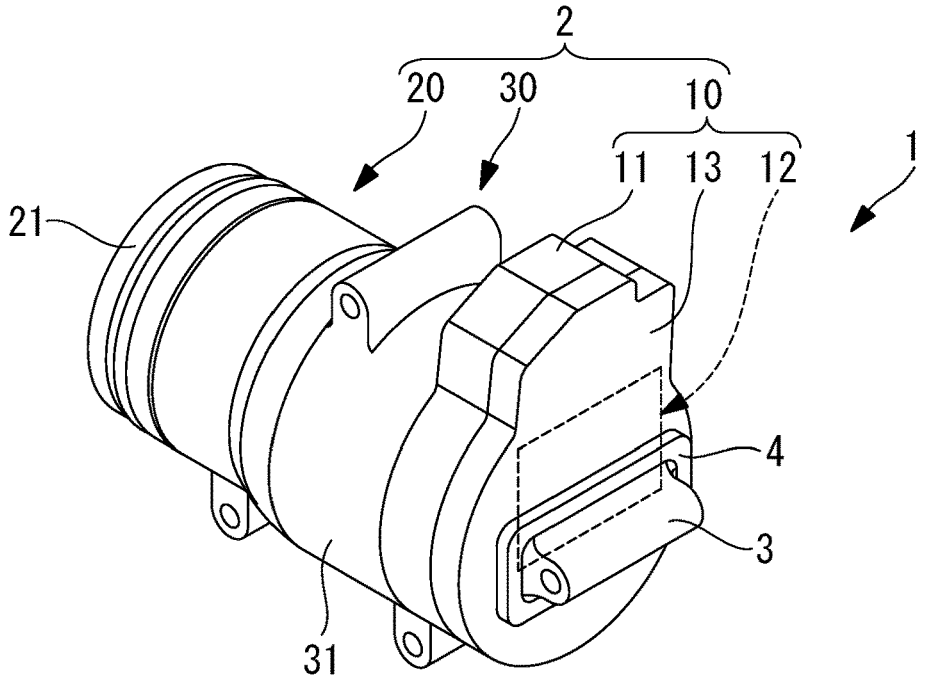
FIG. 1A is a perspective view showing a vehicular electric compressor according to a first embodiment of the present invention and is a perspective view seen from the inverter cover side.
Figure 1B:
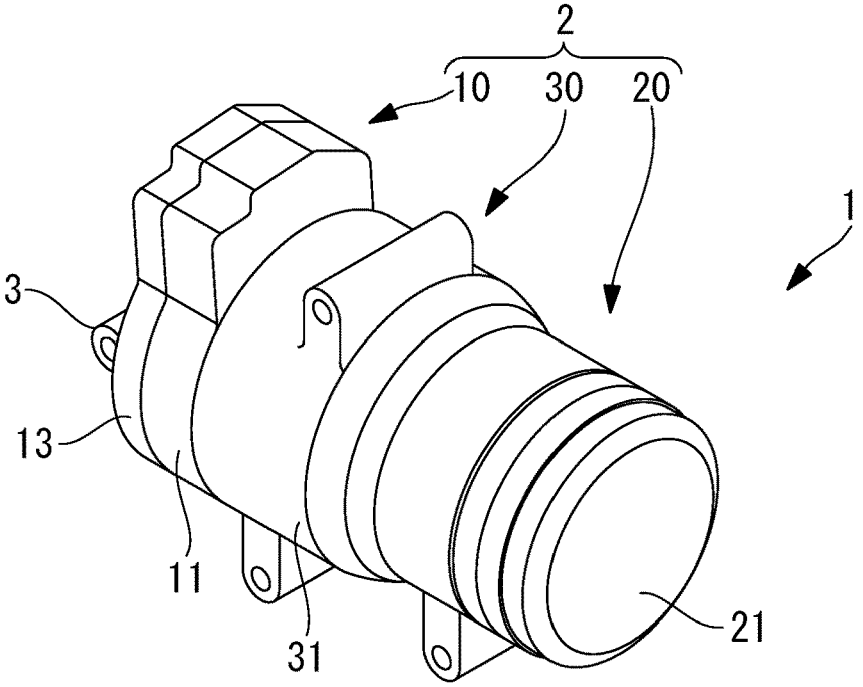
FIG. 1B is a perspective view showing the vehicular electric compressor according to the first embodiment of the present invention and is a perspective view seen from the housing side.

FIGS. 1A and 1B are perspective views showing the vehicular electric compressor according to the first embodiment of the present invention. FIG. 1A is a perspective view of the vehicular electric compressor seen from the inverter cover side, and FIG. 1B is a perspective view of the vehicular electric compressor seen from the housing side. As shown in FIGS. 1A and 1B, a vehicular electric compressor 1 includes a compressor body 2 that compresses fluid sucked from the outside and then discharges the fluid using electric power as power.

A compressor body 2 includes a motor case 31 that accommodates a motor, a compression mechanism, and the like, and a housing (an upper housing) 21 that covers the motor case 31. An inverter case (a lower case) 11 that accommodates an inverter and the like is attached on the motor case 31 on the opposite side of the housing 21.

A compression mechanism, not shown, is accommodated in a part closer to the housing 21 from a central part of the motor case 31. Such a part forms a compression mechanism unit 20 that compresses the fluid sucked from the outside and then discharges the fluid. A motor, not shown, is accommodated in a part closer to the inverter case 11 from the central part of the motor case 31. Such a part forms a motor unit 30 that drives the compression mechanism unit 20.

An inverter 12 that supplies electric power to the motor unit 30 is accommodated in an inverter case 11, and an inverter 12 accommodated in the inverter case 11 is covered with an inverter cover 13. With these components, an inverter unit 10 that operates the motor unit 30 is formed.

In the vehicular electric compressor 1 according to the present embodiment, as shown in FIG. 1A, a plate-like protective component 4 is attached on the inverter cover 13 of the compressor body 2. An external attachment leg 3 is attached to the inverter cover 13 of the compressor body 2 through the protective component 4. The inverter cover 13 of the compressor body 2, the protective component 4, and the external attachment leg 3 are separate components.

The protective component 4 is lower in strength than the external attachment leg 3. The material used for forming the protective component 4 is not particularly limited, but it is preferable to use any material having a lower strength than aluminum alloy, which is used typically as a material of the inverter cover 13 or the external attachment leg 3. Specifically, engineering plastic (enpla) such as polyamide or polycarbonate, super engineering plastic (super enpla) such as polyimide, urethane-based rubber, an epoxy-based adhesive, and any combinations thereof can be cited for the material.

Among the materials that can be used for forming the protective component 4, in a case where enpla, super enpla, and urethane-based rubber are used, the inverter cover 13, the protective component 4, and the external attachment leg 3 are connected by a connection member such as a screw or a bolt. In a case where an adhesive such as an epoxy-based adhesive is used as a material for forming the protective component 4, no connection member is necessary.

Figure 2:
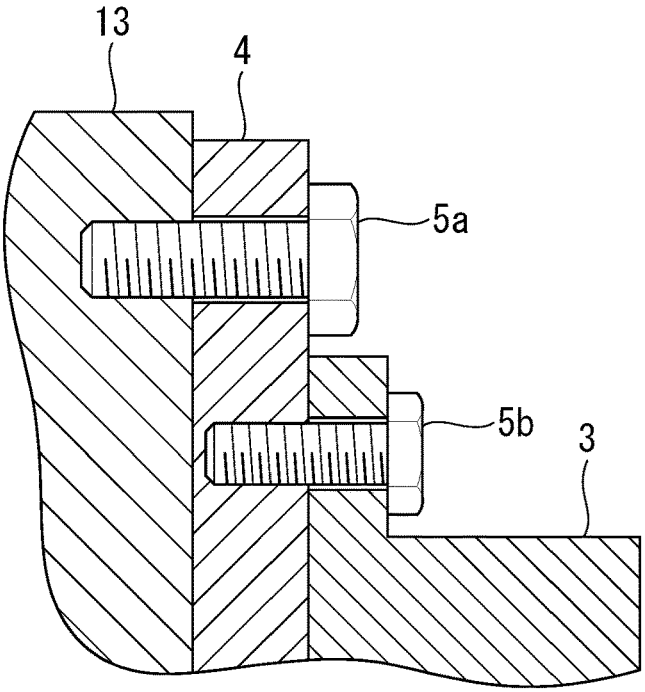
FIG. 2 is an enlarged cross-sectional view of a connection part in a case where an inverter cover, a protective component, and an external attachment leg are connected by a connection member.

FIG. 2 is an enlarged cross-sectional view of the connection part in a case where the inverter cover, the protective component, and the external attachment leg are connected by a connection member. Considering the damage to the compressor body 2, as shown in FIG. 2, it is favorable that the inverter cover 13 and the protective component 4 are connected by a connection member 5*a* and the protective component 4 and the external attachment leg 3 are connected by another connection member 5*b*. Without being limited to this, the connection member can be penetrated from the external attachment leg 3 to the inverter cover 13 for connection.

With the configuration described above, the following effects and advantages are achieved according to the present embodiment.

As described above, in the vehicular electric compressor 1 according to the present embodiment, the external attachment leg 3 is attached to the compressor body 2 (the inverter cover 13). Hence, when the vehicle collides, an excessive load is to be exerted on the external attachment leg 3. At this timing, since the protective component 4 is interposed between the compressor body 2 and the external attachment leg 3, the above load is exerted on the protective component 4. The protective component 4 is lower in strength than the external attachment leg 3, and thus the protective component 4 is certainly broken upon receiving the above load. Therefore, breakage of the inverter cover 13 and exposure of the inverter 12 that occurs accordingly can be prevented.

In particular, in the case where the external attachment leg 3 is attached to the inverter cover 13, the exposure of the inverter 12 caused by the breakage of the inverter cover 13 at the time of vehicle collision and risk of electric leakage that occurs accordingly can be reduced.

In the case where the compressor body 2, the protective component 4, and the external attachment leg 3 are separate components, the protective component 4 can be formed of a different material from the compressor body 2 or the external attachment leg 3. Specifically, by forming the protective component 4 with a material having a lower strength than the compressor body 2 and the external attachment leg 3, the protective component 4 can be more certainly broken at the time of vehicle collision.

For a material of the protective component 4, the above-described enpla, super enpla, urethane-based rubber, and an epoxy-based adhesive can be cited. Aluminum alloy is typically used as a material for the compressor body 2 and the external attachment leg 3. Hence, in the case where the above-described material is used for forming the protective component 4, the protective component 4 having a lower strength than the compressor body 2 and the external attachment leg 3 can be formed more certainly.

In the case where the inverter cover 13, the protective component 4, and the external attachment leg 3 are connected by the connection member, as shown in FIG. 2, the inverter cover 13 and the protective component 4 are connected by the connection member 5*a* and the protective component 4 and the external attachment leg 3 are connected by another connection member 5*b*. In this manner, since the connection member 5*b* does not reach the inverter cover 13, even when an excessive load is exerted on the external attachment leg 3 at the time of vehicle collision, the load can be prevented from being directly exerted on the inverter cover 13 through the connection member 5*b*. Accordingly, the load to be exerted on the compressor body 2 (the inverter cover 13) through the connection members 5*a* and 5*b* at the time of vehicle collision can be prevented. Therefore, damage to the compressor body 2 at the time of vehicle collision can be more certainly reduced.

Second Embodiment

Next, a second embodiment of the present invention will be described with reference to FIG. 3.

The principle configuration according to the present embodiment is basically the same as the configuration in the first embodiment. However, the inverter cover 13 and the protective component 4 are integrated, and the structure of the protective component 4 is different from the structure in the first embodiment. Hence, in the present embodiment, such differences will be described but descriptions of other duplications will be omitted.

The same components as those in the first embodiment are denoted by the same reference numerals, and the duplicated descriptions thereof will be omitted.

In the present embodiment, the inverter cover 13 and the protective component 4 are integrated in the vehicular electric compressor 1. Accordingly, the inverter cover 13 and the protective component 4 are formed of the same material. Without being limited to this, the inverter cover 13 and the protective component 4 (and the external attachment leg 3) may be separate components.

Figure 3:
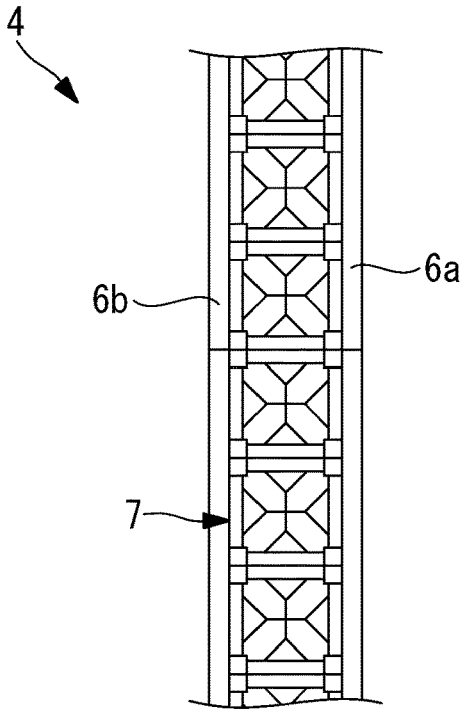
FIG. 3 is a partial side cross-sectional view of a protective component according to a second embodiment of the present invention.
Figure 4A:
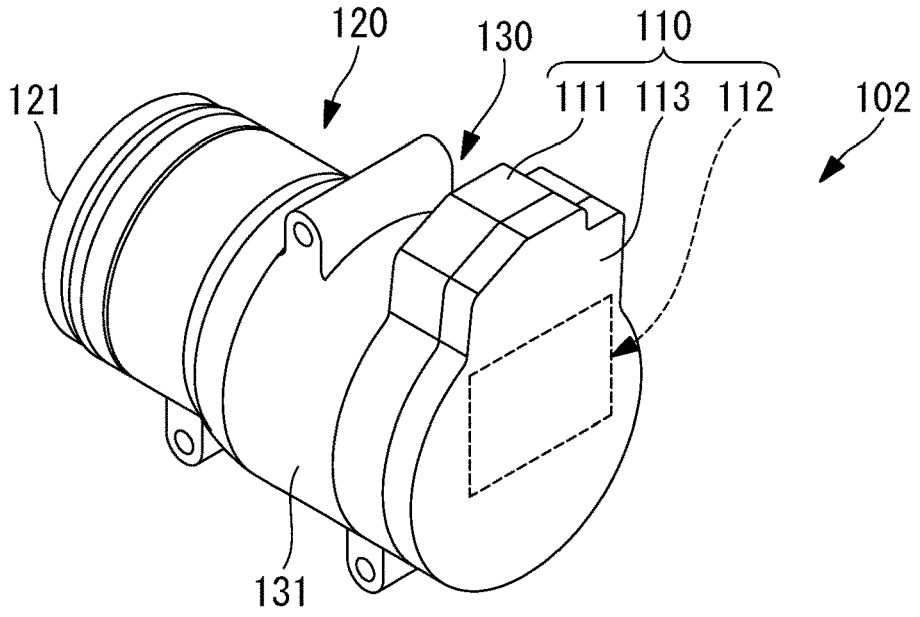
FIG. 4A is a perspective view showing an example of a conventional compressor body and is a perspective view seen from the inverter cover side.
Figure 4B:
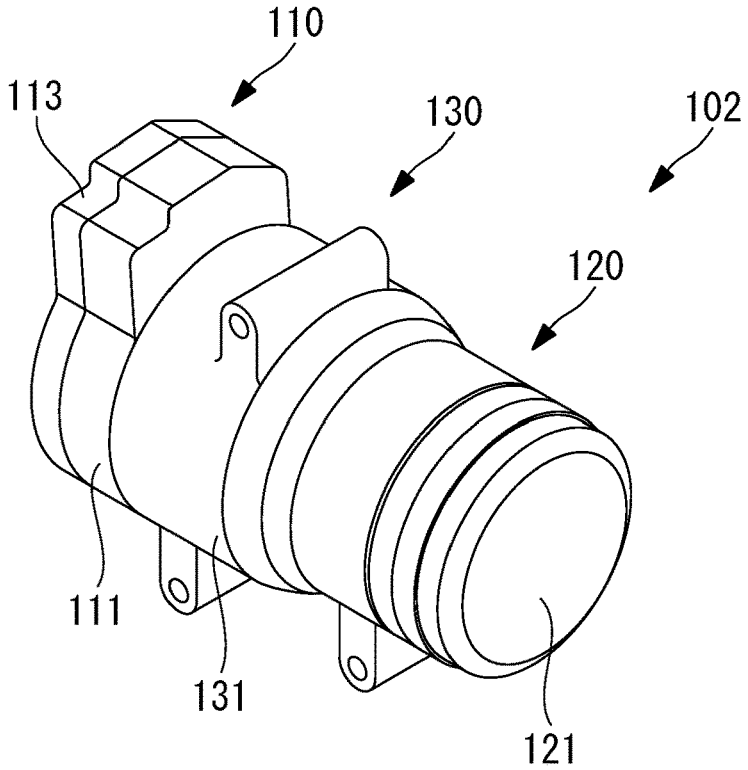
FIG. 4B is a perspective view showing an example of a conventional compressor body and is a perspective view seen from the housing side.
Figure 5A:
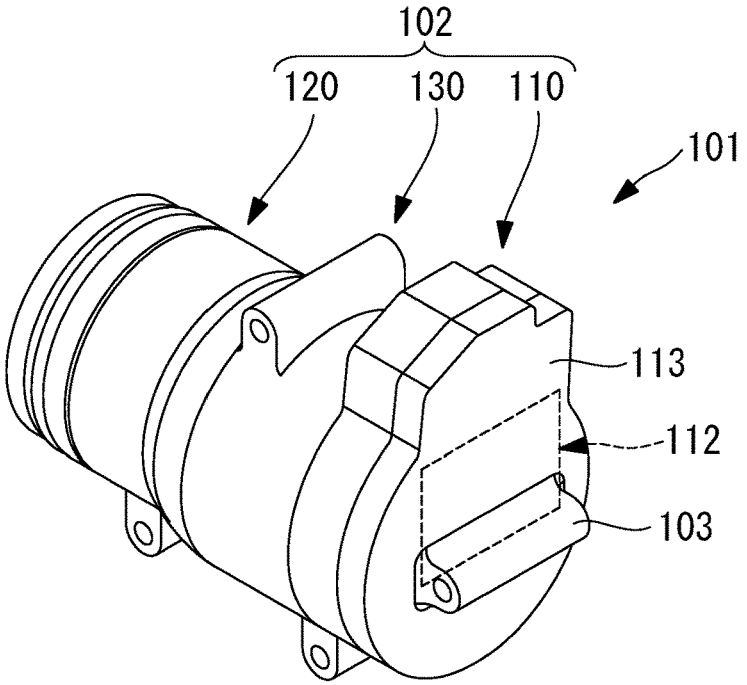
FIG. 5A is a perspective view showing an example of a conventional vehicular electric compressor and is a perspective view seen from the inverter cover side.
Figure 5B:
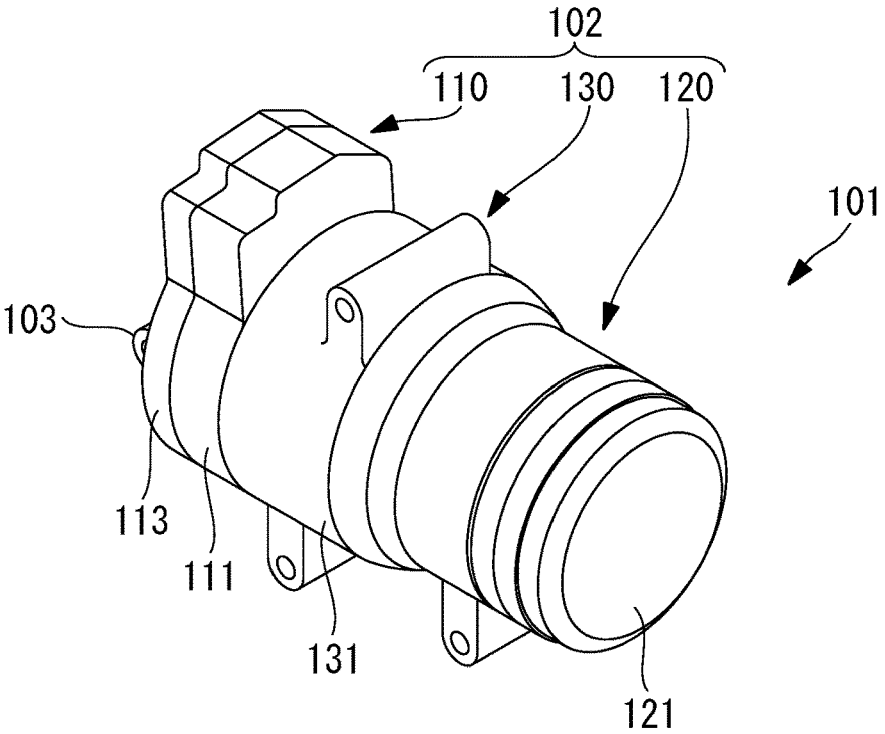
FIG. 5B is a perspective view showing an example of a conventional vehicular electric compressor and is a perspective view seen from the housing side.

FIG. 3 is a partial side cross-sectional view of the protective component according to the present embodiment. In the present embodiment, the protective component 4 includes skin layers 6*a* and 6*b* on front and rear surfaces, respectively, and includes a core layer 7 inside the protective component 4. The core layer 7 has a lattice structure (a truss structure) like a lattice-like beam. With such a configuration, the protective component 4 has a structure lower in strength than the inverter cover 13 or the external attachment leg 3. That is, the protective component 4 serves as an impact absorbing member.

With the configuration described above, the following effects and advantages are achieved according to the present embodiment.

As described above, in the vehicular electric compressor 1 according to the present embodiment, the inverter cover 13 and the protective component 4 are integrated. Therefore, the protective component 4 can be formed of the same material with the inverter cover 13. This can lower the weight of the electric compressor.

In the present embodiment, the protective component 4 has a lattice structure. This structure can cause the protective component 4 to absorb the impact more at the time of vehicle collision and can break the protective component 4. Thus, damage to the compressor body 2 at the time of vehicle collision can be reduced more certainly.

In the above-described two embodiments, the case where the external attachment leg 3 is attached to the inverter cover 13 has been described as an example, but the embodiments are not limited to this. That is, the external attachment leg 3 and the protective component 4 may be attached at any positions of the compressor body 2.

REFERENCE SIGNS LIST

1 vehicular electric compressor
2 compressor body
3 external attachment leg
4 protective component
5*a*, 5*b* connection member
6*a*, 6*b* skin layer
7 core layer
10 inverter unit
11 inverter case (lower case)
12 inverter
13 inverter cover
20 compression mechanism unit
21 housing (upper housing)
30 motor unit
31 motor case

The invention claimed is:

1. A vehicular electric compressor, comprising:

a compressor body that compresses fluid sucked from outside and then discharges the fluid, using electric power as power;

a protective component provided on the compressor body; and an external attachment leg attached to the compressor body through the protective component, wherein the protective component is lower in strength than the external attachment leg, wherein the compressor body comprises a compression mechanism unit that compresses the fluid and then discharges the fluid, a motor unit that drives the compression mechanism unit, and an inverter unit that operates the motor unit, wherein the inverter unit includes an inverter that supplies the electric power to the motor unit, an inverter case that accommodates the inverter, and an inverter cover that covers the inverter accommodated in the inverter case, wherein the inverter cover is provided at an end of the compressor body and the protective component is provided directly on an outer surface of the inverter cover, wherein the external attachment leg is attached to the inverter cover through the protective component and is attached to a part outside the vehicular electric compressor, and wherein a connection between the compressor body and the protective component and another connection between the protective component and the external attachment leg are made respectively by different connection members.

2. The vehicular electric compressor according to claim 1, wherein the compressor body, the protective component, and the external attachment leg are separate components.

3. The vehicular electric compressor according to claim 1, wherein the protective component is formed of at least one material selected from engineering plastic, super engineering plastic, urethane-based rubber, and an epoxy-based adhesive.

* * * * *